US009217244B2

(12) United States Patent
Early et al.

(10) Patent No.: US 9,217,244 B2
(45) Date of Patent: Dec. 22, 2015

(54) PORTABLE STEEL-REINFORCED HDPE PUMP STATION

(71) Applicant: APPALACHIAN TECHNOLOGY SOLUTIONS, LLC., Roanoke, VA (US)

(72) Inventors: Daniel M Early, New Castle, VA (US); Scott F. Easter, Huddleston, VA (US)

(73) Assignee: APPALACHIAN TECHNOLOGY SOLUTIONS, LLC., Roanoke, VA (US)

( * ) Notice: Subject to any disclaimer, the term of this patent is extended or adjusted under 35 U.S.C. 154(b) by 0 days.

(21) Appl. No.: 14/539,999

(22) Filed: Nov. 12, 2014

(65) Prior Publication Data

US 2015/0068616 A1 Mar. 12, 2015

Related U.S. Application Data

(63) Continuation-in-part of application No. 13/277,973, filed on Oct. 20, 2011, now Pat. No. 8,955,539.

(60) Provisional application No. 61/408,282, filed on Oct. 29, 2010.

(51) Int. Cl.

| | |
|---|---|
| ***E03F 5/02*** | (2006.01) |
| ***E03F 5/22*** | (2006.01) |
| ***B65D 90/10*** | (2006.01) |

(52) U.S. Cl.

CPC . *E03F 5/22* (2013.01); *B65D 90/10* (2013.01); *E03F 5/024* (2013.01); *Y10T 137/6991* (2015.04)

(58) Field of Classification Search

CPC ... E03F 5/024; Y10T 137/6991; E02D 21/12; B65D 90/10

USPC ..... 52/19, 20, 21

See application file for complete search history.

(56) References Cited

U.S. PATENT DOCUMENTS

| | | | | |
|---|---|---|---|---|
| 3,217,077 | A * | 11/1965 | Cocke | 264/256 |
| 3,938,545 | A | 2/1976 | Nagy et al. | |
| 4,102,088 | A * | 7/1978 | Keller et al. | 52/20 |
| 4,594,153 | A | 6/1986 | Weis | |
| 4,661,047 | A | 4/1987 | Weis | |
| 5,032,197 | A * | 7/1991 | Trimble | 156/71 |

(Continued)

FOREIGN PATENT DOCUMENTS

| | | |
|---|---|---|
| CN | 101413507 A | 4/2009 |

*Primary Examiner* — Kevin Murphy

(74) *Attorney, Agent, or Firm* — Richard C Litman

(57) ABSTRACT

The portable steel-reinforced HDPE pump station includes a vertically upright, cylindrical wet well fabricated from high-density polyethylene reinforced by helically wound steel ribs. HDPE profile wall material and endoskeleton are used for wet well reinforcement. Exterior foam insulation or thin HDPE shell wrap are disposed on outer portion of the wet well. The base of the pump station includes cross ribs atop a planar anti-flotation collar. Interior spaces between the cross ribs are filled with concrete to anchor the wet well in situ. Alternatively, a steel plate is used as a base. The steel plate base may be encapsulated by an HDPE sheet. HDPE sheets form a sloping hopper bottom at lower inside portion of the wet well. The annular space between the hopper bottom and base plate is filled solid with a closed-cell polyurethane insulation. Alternatively the wet wall is constructed of structurally reinforced thermoplastic without steel reinforcement ribs.

13 Claims, 13 Drawing Sheets

(56) References Cited

U.S. PATENT DOCUMENTS

| | | | | |
|---|---|---|---|---|
| 5,081,802 | A * | 1/1992 | Westhoff et al. | 52/20 |
| 5,205,592 | A * | 4/1993 | Ziu | 285/45 |
| 5,271,193 | A * | 12/1993 | Olsen et al. | 52/19 |
| 5,386,669 | A * | 2/1995 | Almeida | 52/19 |
| 5,405,218 | A * | 4/1995 | Hyde-Smith | 405/303 |
| 5,435,664 | A | 7/1995 | Pettersson | |
| 5,613,806 | A * | 3/1997 | House et al. | 405/150.1 |
| 6,059,208 | A * | 5/2000 | Struthers | 241/46.01 |
| 6,644,342 | B1 * | 11/2003 | Bogan et al. | 137/364 |
| 7,150,290 | B1 * | 12/2006 | Smith | 137/363 |
| 2003/0190742 | A1 | 10/2003 | Whiteman | |
| 2007/0000184 | A1 * | 1/2007 | Koteskey | 52/20 |
| 2010/0084409 | A1 | 4/2010 | Burwell | |
| 2012/0097590 | A1 | 4/2012 | Early et al. | |
| 2012/0107137 | A1 | 5/2012 | Early et al. | |
| 2012/0111428 | A1 | 5/2012 | Early et al. | |

* cited by examiner

PORTABLE STEEL-REINFORCED HDPE PUMP STATION

CROSS-REFERENCE TO RELATED APPLICATION

This application is a continuation-in-part of U.S. patent application Ser. No. 13/277,973, filed Oct. 20, 2011, which claims the benefit of U.S. Provisional Patent Application Ser. No. 61/408,282, filed Oct. 29, 2010.

BACKGROUND OF THE INVENTION

1. Field of the Invention

The present invention relates to pump stations, and particularly to a portable steel-reinforced HDPE pump station having a wet well made from plastic, preferably high-density polyethylene (HDPE) that is structurally reinforced with steel.

2. Description of the Related Art

A pump station is a device assembled from a variety of mechanical and structural components that, when combined into a working system, will permit the opportunity to convey wastewater from one location to another by mechanical means. The typical pump station configuration would typically collect wastewater at a localized lower elevation and mechanically transport or "lift" the wastewater to a higher elevation. The conveyance of wastewater is accomplished by the connection of the pump station to a wastewater discharge piping system, commonly referred to as a "force main". The forcemain permits the conveyance of wastewater from the pump station to a point of discharge. The point of discharge is typically to a gravity sewer, another pump station, or a wastewater treatment plant or other such facility that would receive wastewater or storm water.

Conventional pump station designs developed and utilized during the past 150 years were typically constructed from steel and/or concrete. These materials were readily available and easily adapted to pump station construction and operation. However, it is fully recognized that these materials, while abundant and reliable, possess drawbacks relative to overall life cycle duration. In particular, wastewater exhibits aggressive corrosion tendencies related to the generation of sulfuric acid that results from the formation of hydrogen sulfide gas.

Gaseous sulfuric acid will attack and corrode concrete and unprotected steel, and after continued exposure and corrosion, will result in a structurally deficient system that can collapse or permit leakage of wastewater to the local environment or permit the intrusion of groundwater into the local sewer system. In any of these instances, the sewer system owner will need to provide significant repairs or total replacement of the steel and concrete systems, which tends to be very costly.

Thus, a portable steel-reinforced HDPE pump station solving the aforementioned problems is desired.

SUMMARY OF THE INVENTION

The portable steel-reinforced HDPE pump station includes a vertically upright cylindrical wet well fabricated from structurally reinforced plastic. Pumps are disposed in the wet well. A pipe connected to the pumps extends to the outside of the wet well to allow outflow of water to external systems. An access hatch covers the upper portion of the wet well and is arranged above grade. The remainder of the wet well is disposed in the ground below grade. Vertically disposed sliding rails are attached inside the wet well and extend upward from a working area of the well to the top of the well near the service hatch. The pumps are slidably attached to the rails and attached to a pull chain to facilitate sliding installation and removal of the pumps by way of the access hatch. A water-receiving inlet pipe extends into the wet well, the inlet pipe allowing entry of water inside the wet well. The HDPE pump station may function for wastewater transfer, water conveyance, and irrigation.

Preferably, the tank is equipped with a bottom plate, which serves as an antifloatation collar, thereby preventing inadvertent floatation of an empty tank that may occur during or after construction. The pump station may be pre-assembled, providing a lightweight, rugged pump station that is easily fabricated, easily transported, and easily installed at the project site.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The structurally reinforced HDPE pump station provides a pre-assembled pump station that can pump wastewater or clean water for such purposes as wastewater transfer, water conveyance, and irrigation. The pump station is designed to be utilized by public and private sector entities, such as towns, counties, cities, townships, state agencies, federal agencies, private individuals, commercial entities, industrial facilities, and agricultural facilities.

The pump station receives water or wastewater from a variety of conventional sources, such as gravity sewer, water pipes, streams, or other water collection systems. The water or wastewater enters a wet well that is an upright vertical cylinder manufactured from steel-reinforced plastic. The wet well houses one or more pumping systems that will convey water or wastewater by a pipe that connects the pumps to an external piping or water receiving system. Additional internal components may include a slide rail assembly to facilitate the installation and removal of pumps, internal piping that will connect the pump or pumps to external piping, an inlet pipe to receive water, a trash basket to collect trash that can be transported in the water or wastewater, a water level monitoring system that will control pump activation and alarms, and an access hatch in the top of the pump station that will provide access to the internal pump station components. During pump station operation, water enters the pump station and begins to fill the wet well basin. The water level will rise until the level monitor detects the water at a prescribed level. The level monitor signals an external pump control panel that activates the internal pump or pumps. The pumps begin pumping water and discharging the water through the internal pipes, which are connected to an external water receiving system, such as another pipe system, ditch, tank, or other such device or system. When the water level decreases due to pumping action and the level monitor detects water at a prescribed lower water level, the level monitor signals the external pump control panel, which, in turn, deactivates the pump or pumps. The operation is repeated as needed, based upon the water inflow rate into the wet well.

Figure 1:
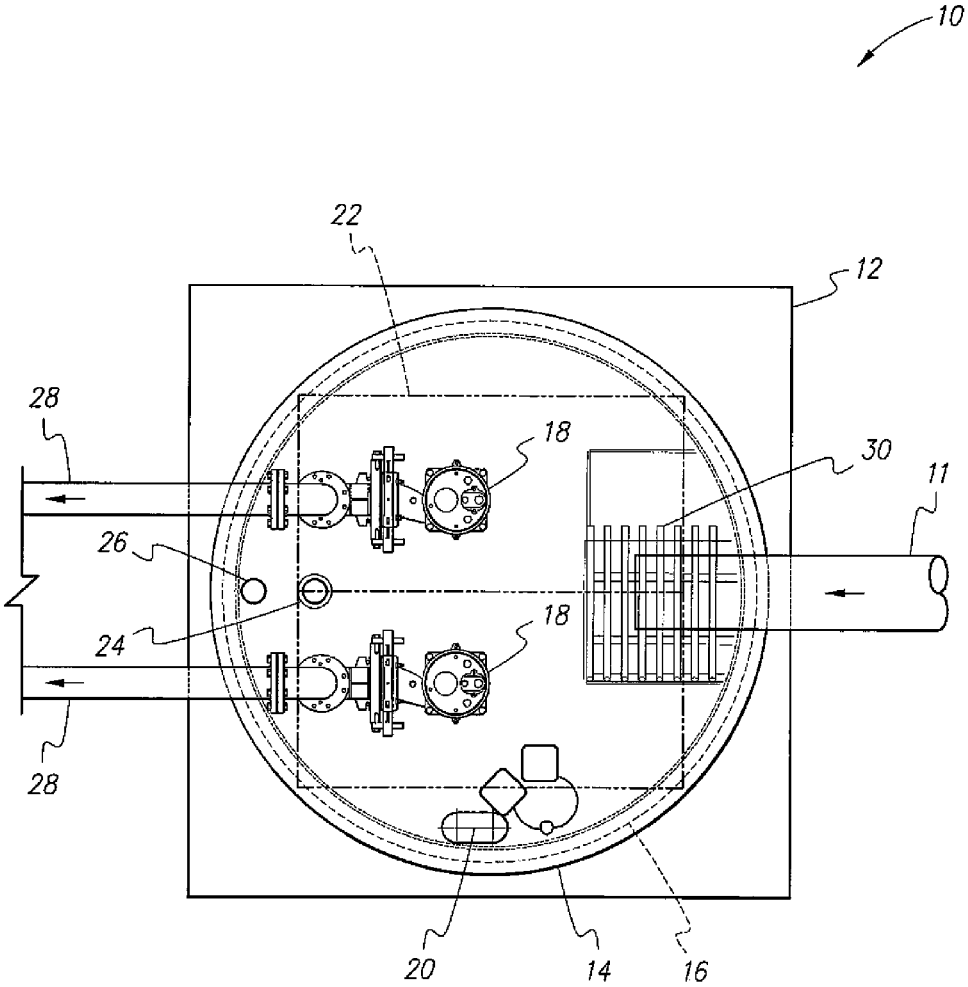
FIG. 1 is a top plan view of the portable steel-reinforced HDPE pump station according to the present invention, shown with the access cover removed.
Figure 2:
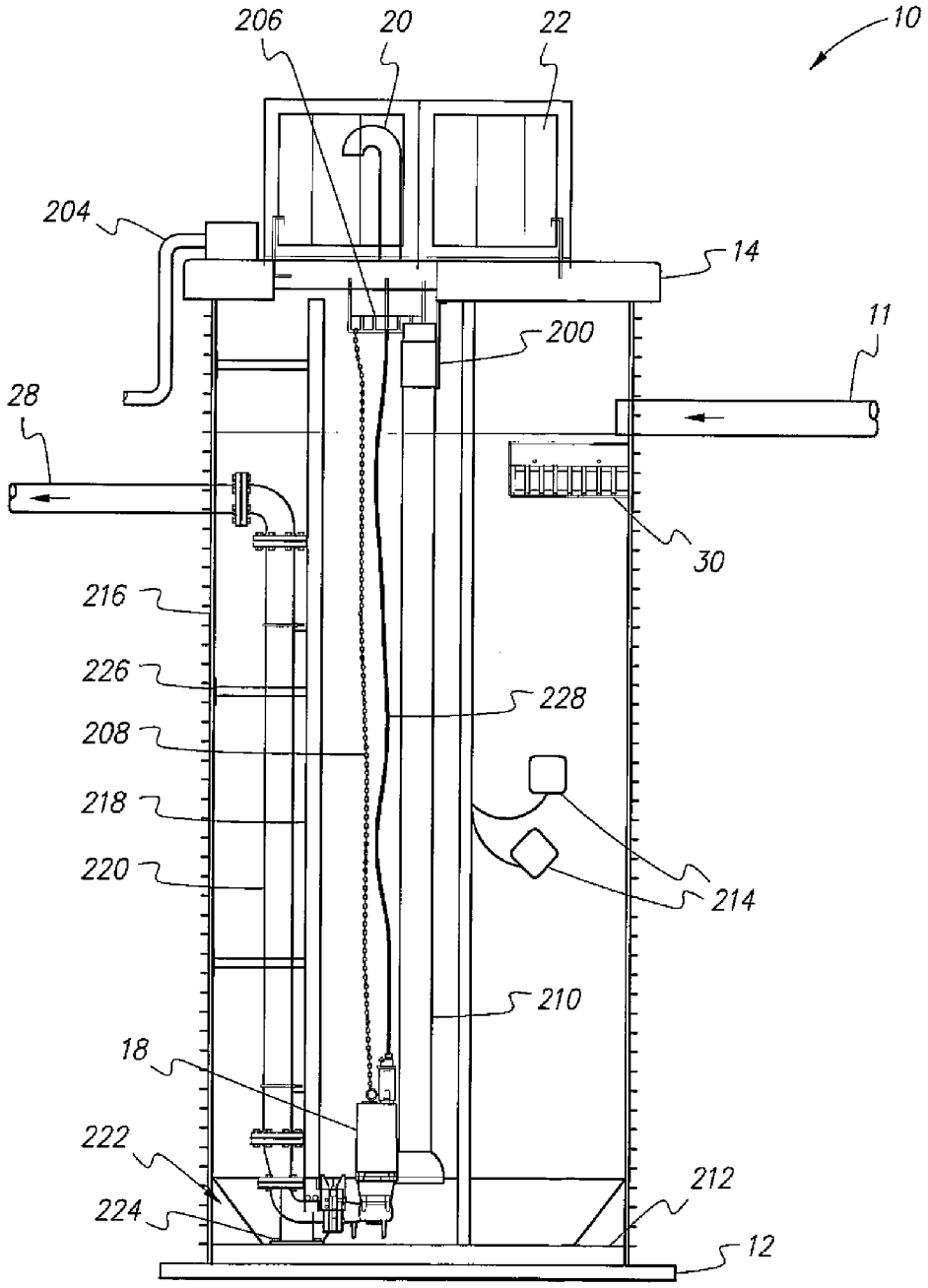
FIG. 2 is a partial, diagrammatic side view of the steel-reinforced HDPE pump station according to the present invention.
Figure 3:
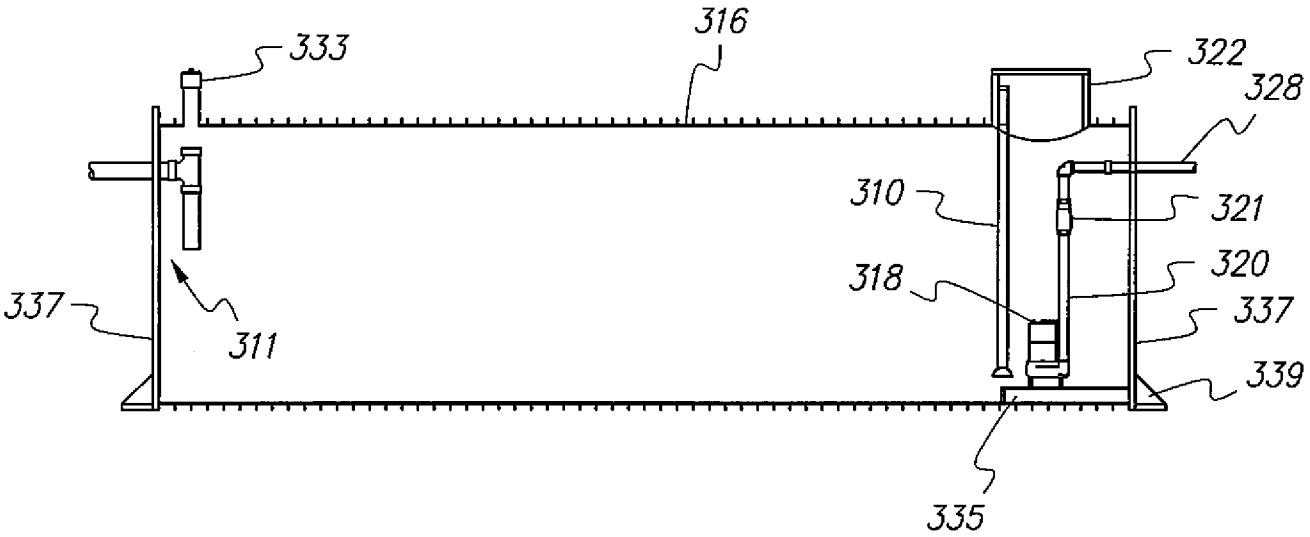
FIG. 3 is a side view of a horizontally oriented steel-reinforced HDPE pump station according to the present invention.
Figure 4:
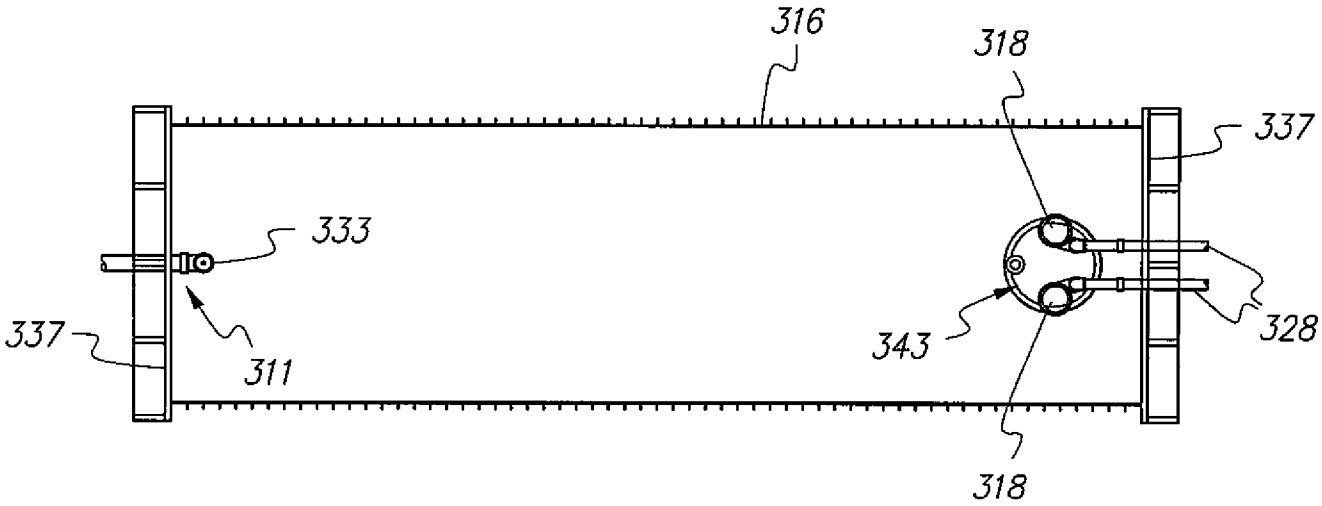
FIG. 4 is a diagrammatic top plan view of the horizontally oriented steel-reinforced HDPE pump station according to the present invention.
Figure 6:
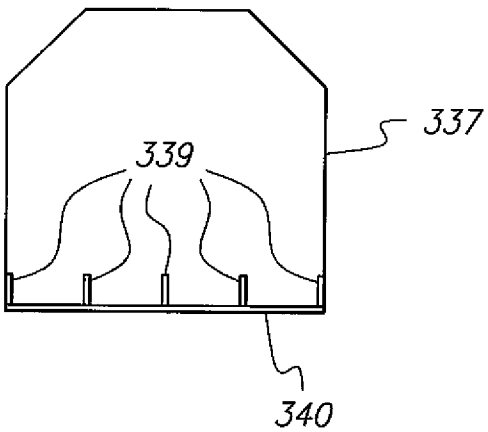
FIG. 6 is a front view of a bulkhead assembly of the horizontally oriented steel-reinforced HDPE pump station according to the present invention.
Figure 5:
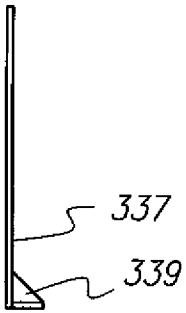
FIG. 5 is a side view of a bulkhead assembly of the horizontally oriented steel-reinforced HDPE pump station according to the present invention.

As shown in FIGS. 1-2, the structurally reinforced HDPE pump station 10 includes a wet well 216 made from a plastic, vertically upright, cylindrical pipe having submersible effluent pumps 18 disposed inside. The pumps 18 are operably connected to flow pipes 28 by pump flange seat assemblies 224 at the bottom of the cylindrical wet well 216. The pipes 28 are partially disposed in the wet well 216 and are connected to their respective effluent pumps 18 by plastic forcemain risers 220. The pipes 28 extend to the outside of the wet well 216 to allow outflow of water to external systems. An access hatch 22 covers the upper portion of the wet well 216 and is arranged above grade. The remainder of the wet well 216 is disposed in the ground, below grade.

Vertically disposed sliding rails 218 are attached to the wall of the wet well 216 inside the wet well 216 by mounting brackets 226, and extend upward from a working area of the well to the top of the well near the access hatch 22. The pumps 18 are slidably attached to the rails 218 to facilitate sliding installation and removal of the pumps 18 by way of the access hatch 22. A pump hoist chain 208 is attached to each pump 18 and disposed through a pump hoist lift socket 26.

The structurally reinforced HDPE wet well 216 has annular corrugations along the exterior sidewall of the wet well. A water-receiving inlet pipe 11 extends into the wet well 216, the inlet pipe 11 allowing entry of water inside the wet well 216. A removable bar screen 30 made from HDPE is disposed below the inlet pipe 11 to capture solids entrained in water flowing through the pipe 11.

The bottom portion of the wet well 216 extends into an HDPE filler block 222 attached to and resting on top of an ultra-high molecular weight (UHMW) plastic anchor block 212, which, in turn, is disposed on top of a substantially square-shaped antiflotation collar 12. The antiflotation collar 12 is preferably made of high-density polyethylene (HDPE) thermoplastic material. The top portion or rim 16 of the wet well 216 extends into an aluminum boilerplate top lid 14. The top lid 14 is annular and fits over the open top portion 16 of the structurally reinforced HDPE cylindrical wet well 216. The overall dimensions and configuration of the pumping station 10 may vary according to pipe diameters available from the manufacturer.

A PVC vent 20 extends upward from the top lid 14 and includes an insect barrier. The vent 20, preferably a four-inch SCH 40 vent, provides fresh air ventilation to the interior of the wet well 216.

A pressure bell pump electronic control assembly 24 is disposed in the wet well 216 between the two effluent pumps 18. The control assembly 24 includes level monitor sensors, which detect the water at a first predetermined level and actuate the pumps 18 at the first predetermined level. When water in the system 10 is detected at a second, lower predetermined level, the pumps 18 are deactivated. Additionally, alarms may further be provided for monitoring water levels and operation of the pumps 18. The sensors are held in place near the top interior center inside of the wet well 216 with stainless steel mounting brackets and bolts 200, which secure the elongate housing of the pressure transducer pump controller 210. The bottom portion of the housing of the pressure transducer pump controller 210 is attached to the pump station 10 in a lower internal portion of the station 10 inside of the wet well 216. An electrical cable 228 is electrically connected to the pumps 18, the cable 228 being routed through a conduit cabling hanger 206 and an electric conduit 204 that extends to a control panel external of the pump station 10. A stainless steel mast includes retrievable floats 214 and extends vertically inside the unit 10, being bolted to the floor and the top of the pumping station 10 inside of wet well 216.

Contech Construction Products, Inc., of West Chester, Ohio manufactures a high-density polyethylene (HDPE) piping possessing a steel exterior spiral-ribbed banding that is further encapsulated with a high-density polyethylene plastic, sold under the name Duromaxx™. Such a material, or similar materials, may be used in the manufacture of the wet well 216 to provide increased earth and dynamic load support.

The control panel preferably includes both manual and automatic switches, indicator lights, audible warning horns, visible warning lights, and an optional auto-dialer mechanism that can notify a manned station in the event of a wastewater treatment mechanical problem.

As shown in FIGS. 3-6, a horizontally oriented HDPE wet well 316 can be utilized in environments unsuitable for vertical installations. As most clearly shown in the side view of FIG. 3, the horizontal HDPE wet well 316 has a plastic tee inlet assembly 311 connected to an inlet pipe, which extends outward from a first side of the unit 316. A cleanout inspection port 333 is attached to the wet well and extends upward from a port inspection opening in the wet well proximate the inlet assembly 311. Maintenance access to the inlet assembly 311 can be provided via the cleanout inspection port 333.

Moreover, a pump assembly 318 is positioned inside the wet well 316 near the well's bottom portion, the pump assembly 318 being affixed to an HDPE pump platform 335, which is attached to portions of a lower internal radial surface of the well 316 on the side of the well 316 opposite the inlet assembly side.

An access conduit and hatch assembly 322 covers an access opening 343, and provides maintenance access to a pressure transducer conduit 310, the pumps 318, and the like. The pressure transducer conduit 310 is clamped to the interior of the tank 316 proximate the access hatch assembly 322. The pressure transducer conduit 310 extends downward to a point proximate the bottom of wet well 316.

A rigid plastic forcemain 320 is connected to and extends upward from the pump assembly 318. There are two plastic forcemains 320, one for each pump of the pump assembly 318. A check valve 321 may be installed in-line with the forcemain 320 as a backflow preventer.

Effluent pipes 328 are connected to the forcemains 320 and exit the well 316 to deliver fluid flow therefrom.

The opposing ends of the wet well 316 are sealed by attachment of two HDPE bulkheads 337. Each HDPE bulkhead 337 is pivotally stabilized by an HDPE stabilization plate 340 disposed across the bottom of the bulkhead 337. Triangular gussets 339 extend from the HDPE stabilization plate 340 at predetermined intervals laterally along the plate 340.

Figure 7:
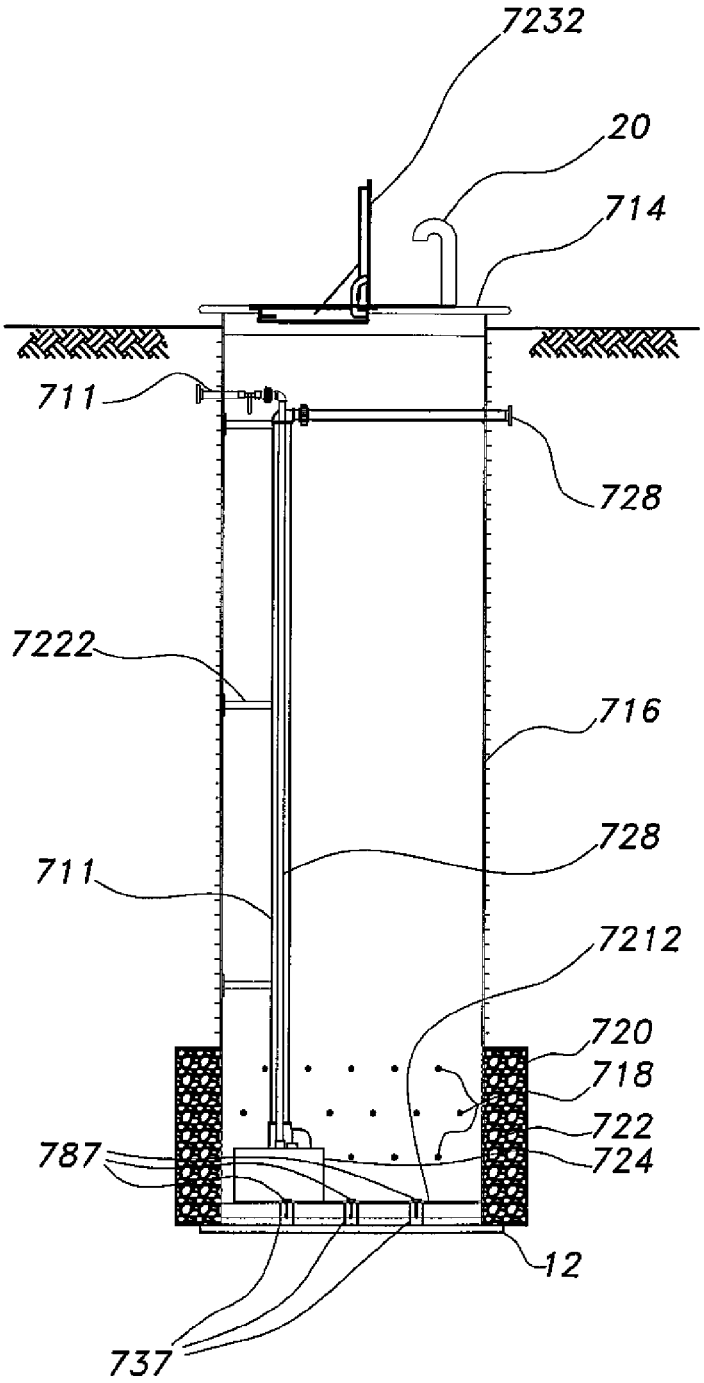
FIG. 7 is a partial, diagrammatic side view of the steel-reinforced HDPE station adapted for use as a cistern according to the present invention.

As shown in FIG. 7, a vertically oriented structurally reinforced polyethylene (SRPE) wet well can be utilized as a cistern 716. Hole perforations 718 are disposed in the SRPE wet well cistern 716 near its bottom to facilitate the infiltration of ground water. The wet wall cistern 716 includes a hatch 7232 attached to an HDPE top plate 714, and a vent pipe 20 extending from an HDPE top plate 714. An air inlet line 711 connected to an external blower assembly enters the cistern wall at its top and extends and connects to a positive displacement air lift pump 724 at the bottom of the cistern 716. A positive displacement air lift pump is preferred, but any type of pump is suitable.

An outlet pipe 728 is attached to a pump 724 at the cistern bottom and extends to a top portion of the cistern where it exits the cistern wall. The outlet pipe 728 and air inlet pipe 711 are supported by plastic mounting brackets 7222. The bottom of the cistern 716 includes an HDPE base plate 7212, which rests atop HDPE stiffeners 737, which rest atop an antiflotation collar 12.

HDPE stiffeners 737 extend from and attach to internal opposite sides of the cistern 716 wall and are fuse welded thereto. The HDPE stiffeners 737 are attached by fuse welding to the antiflotation collar 12 and are connected to the base plate 7212 by countersunk fasteners 787 extending through the base plate 7212 into the stiffeners 737 The countersunk holes are filled solid with HDPE material. The base plate 7212 is attached by fuse welding to the cistern 716 wall.

An alternative bottom to the cistern 716 would be the use of a non-compressible filler material between the base plate 7212 and antiflotation collar 12 in lieu of the stiffeners 737. A porous stone/synthetic stone aggregate 722 extends upward from the antiflotation collar 12 and itself collars the perforated region of the cistern 716 A filter fabric 720 covers the aggregate collar 722 and prevents infiltration and clogging of the holes 718 by fine materials.

While the above-described embodiments of the portable steel-reinforced HDPE pump stations are effective for their intended purpose, there are still some problems to be resolved, particularly for vertically oriented embodiments of the pump station. Loads applied to vertical pump stations are different from loads applied to horizontally buried applications. Unlike the direct earth loads applied to horizontal vessels, direct soil loads are rarely applied to the top of a vertical vessel. A vertical vessel not only must resist horizontal pressures, but must also resist vertical forces due to soil compaction. As the surrounding soil or backfill settles around the vertical vessel, shear or downdrag forces are applied to the vessel's outer shell. The drag-down force exerted onto the structure as the backfill material consolidates can be significant, and in the case of polyethylene material reinforced by external steel reinforcement ribs as described above, could cause the steel ribs to deflect from their perpendicular state. This deflection reduces the overall section modulus of the vessel, and thus reduces its strength. A significant reduction in section modulus could cause a structural failure to the vessel. Steel-reinforced polyethylene has not been utilized in vertical applications due to the issues noted above. Previous considerations have been to envelope the steel-reinforced polyethylene with a cementitious material in the field, such as flowable fill or the like. While this approach would achieve the desired result of protecting the steel-reinforced polyethylene ribs, it is not practical or cost effective.

Figure 8:
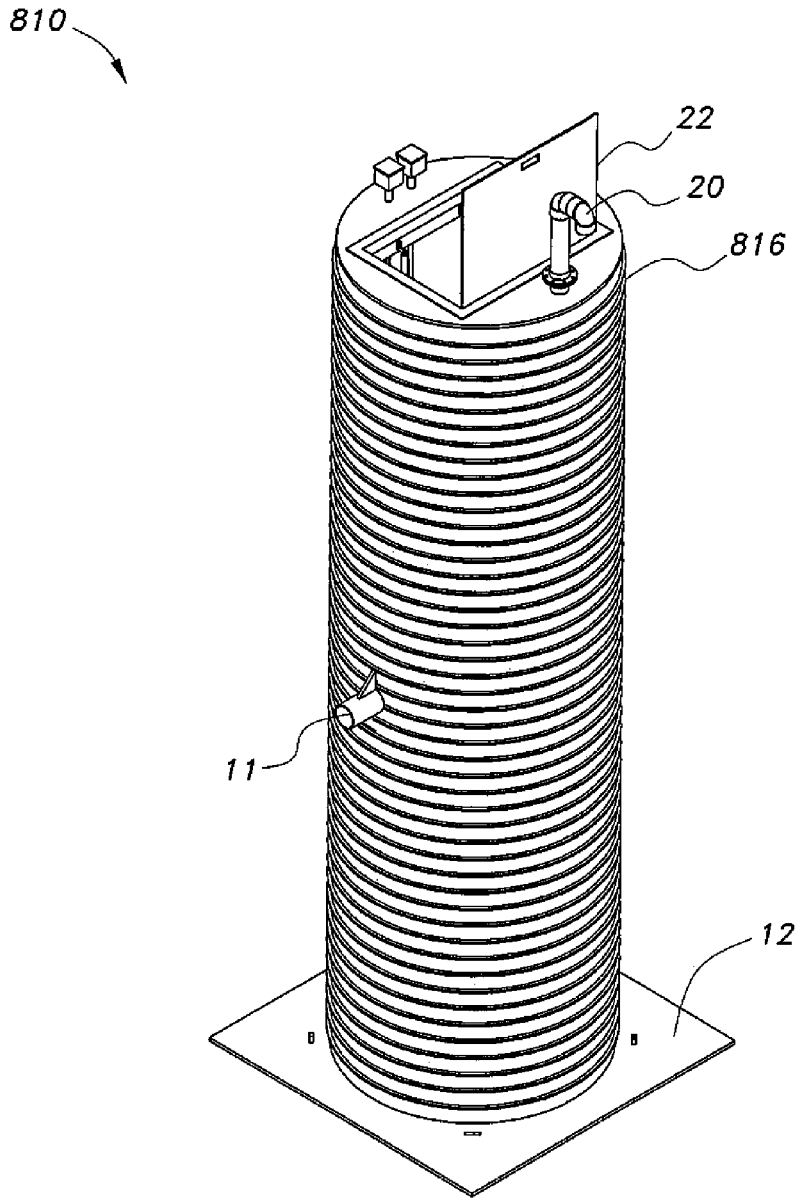
FIG. 8 is a perspective view of an alternative embodiment of a portable steel-reinforced HDPE pump station according to the present invention.
Figure 9:
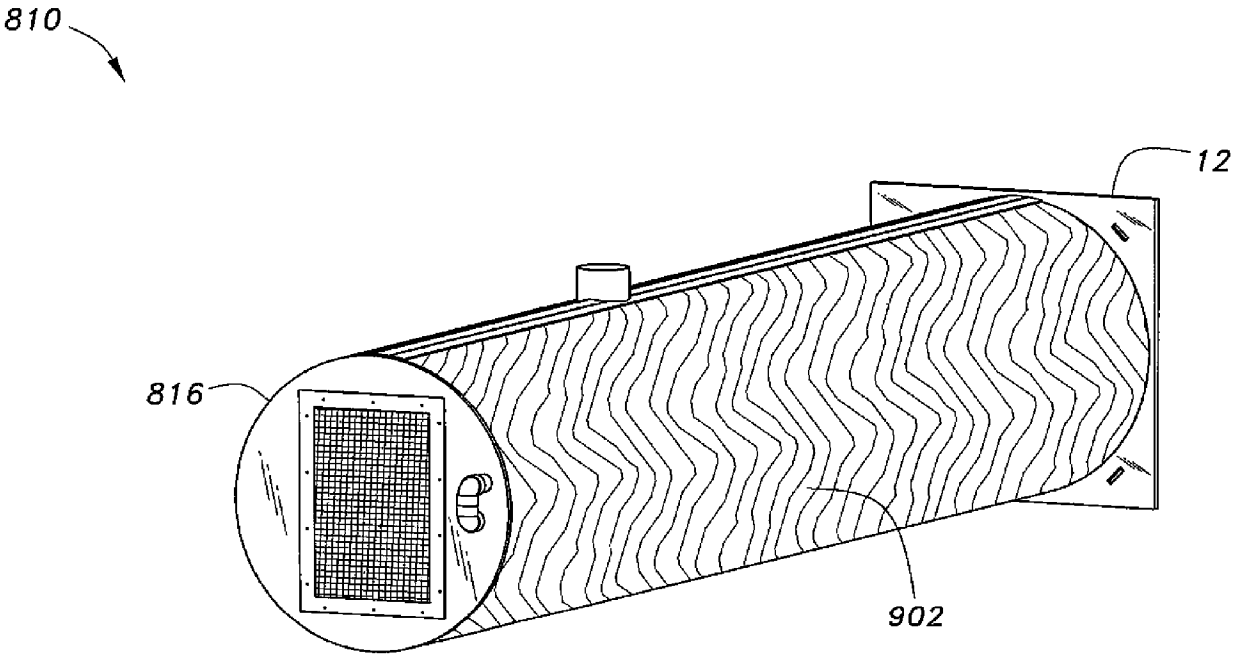
FIG. 9 is a perspective view of an alternative embodiment of a portable steel-reinforced HDPE pump station according to the present invention, shown on its side and having the thin HDPE sheet wrap surrounding the wet well according to the present invention.

The pump station embodiment 810 shown in FIG. 8 includes a cylindrical wet well 816 that may be fitted with structural integrity enhancements, for example, a thin HDPE sheet 902 that forms a wrap (shown in FIG. 9) disposed on exterior portion of the wet well 816. The reinforced polyethylene wet well 816 is wrapped with the thin HDPE sheet material 902 by wrapping the SRPE exterior wall while fuse welding the seams of the thin HDPE sheet 902. The sheet material, by nature of the welding practice, is fuse-welded to the external HDPE encapsulating the steel ribs at all crossings between the SRPE ribs and the HDPE sheet seams. This approach permits the steel reinforced polyethylene wet well 816 to be utilized for vertical pump stations and other vertical applications, such as manholes and basins. It should be understood that the HDPE sheet 902 could also be used to wrap any type of thermoplastic wet well such as, for example, a Weholite™ Profile Wall that does not have steel reinforcing ribs.

Figure 10:
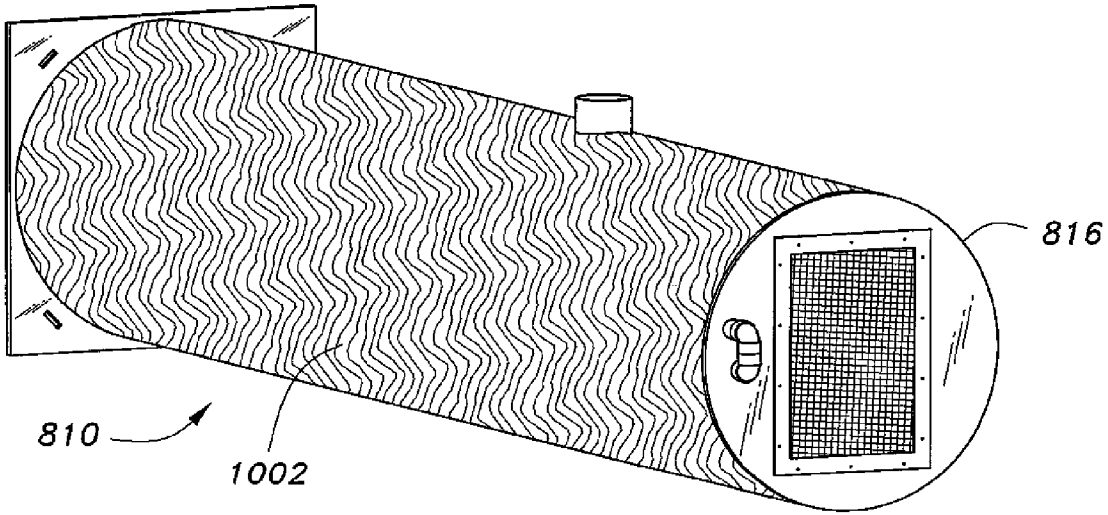
FIG. 10 is a perspective view of a portable steel-reinforced HDPE pump station on its side, showing foam insulation disposed on the wet well according to the present invention.

Alternatively, as shown in FIG. 10, exterior foam insulation 1002 may be disposed on the exterior portion of the wet well 816. This closed-cell polyurethane foam insulation 1002 or equivalent material is applied by spraying the material directly onto the exterior of the steel-reinforced polyethylene wet well 816. The foam is finished in one of two methods. The first method is to apply the foam in two coats. The first coat is applied and expands to create a base. The second coat is the finish coat, whereby the installer can create a relatively smooth surface. The finish coat, e.g., may be approximately 0.5" beyond the edge of the steel reinforced polyethylene ribs of the wet well 816 and have a total depth of approximately 2.5". The second method, involves only a single coat that extends beyond the ribs of wet well 816. A screed is utilized to smooth out the insulation by using the steel-reinforced polyethylene ends as a guide such that the insulation depth matches that of the steel-reinforced polyethylene ribs of the wet well. The importance of both methods is that the final configuration is relatively smooth to create a slip plane with the adjacent backfill, forbidding any downdrag loads from being transferred to the steel-reinforced polyethylene ribs of the wet well 816. An additional value of the insulation is its inherent insulating properties. The insulation provides an R-value of 6.8 per inch of thickness. The portable pump station 810 may be wrapped in heavy duty shrink wrap in order to protect the insulation during shipment. Moreover, it should be understood that the exterior foam insulation 1002 could also be applied to any type of thermoplastic wet well such as, for example, a Weholite™ Profile Wall that does not have steel reinforcing ribs. Thermoplastics contemplated for wet well construction include but are not limited to polyethelenes (PEs), polyvinyl chlorides (PVCs), or the like.

Figure 11:
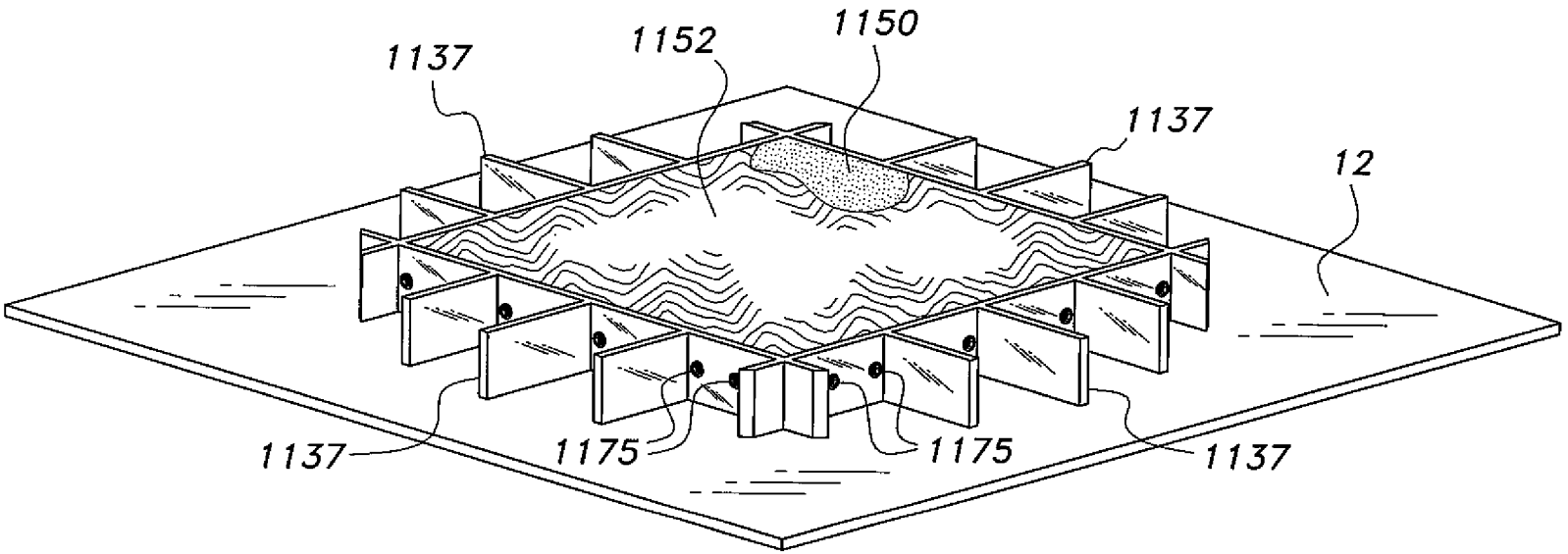
FIG. 11 is a perspective view of a concrete base plate disposed on the anti-floatation collar according to the present invention.

Another problem with vertically oriented pump stations is that large horsepower pumps are heavy and impart dynamic/torque loads that must be resisted by the pump station's base. In order to effectively resist these loads, a cast-in-place concrete base 1150 (shown in FIG. 11) is designed in accordance with ACI standards to withstand the imposed vibratory, axial, moment and torque loads generated by the submersible pump assembly. As shown in FIG. 11, a lattice is formed by elongate HDPE stiffener cross rib members 1137 disposed on top of the planar antiflotation collar 12. The concrete base 1150 is poured within the lattice (which creates the formwork for the concrete) of members 1137 in the base assembly. This configuration anchors the concrete base 1150 in a position centered over the antiflotation collar 12. The concrete base 1150 is further anchored with threaded steel rods 1175 extending through and anchored to the HDPE stiffener cross rib members 1137. The concrete base anchor 1150 is fully encapsulated by the HDPE antiflotation collar 12, HDPE stiffener cross rib members 1137 and the HDPE base plate 7212. The guide rail assembly 218 (shown in FIG. 13) for the pumps, such as pump 18, is attached to the concrete base 1150 by drilling and installing anchor bolts with a suitable adhesive. The anchor bolts do not penetrate the bottom anti flotation collar 12 of the wet well. Alternatively, the guide rail assembly 218 could be attached to the concrete base 1150 via an interconnecting elbow member extending from the concrete base 1150. The concrete base 1150 is encapsulated in HDPE sheet material 1152. Therefore, the wet well remains entirely watertight and resistant to water intrusion or extrusion. Although the concrete base 1150 adds some mass to the pump station, nevertheless, the pump station may still be factory assembled and remains light enough to be portable, since the remainder of the wet well body is made from reinforced plastic and HDPE sheet material.

Figure 12:
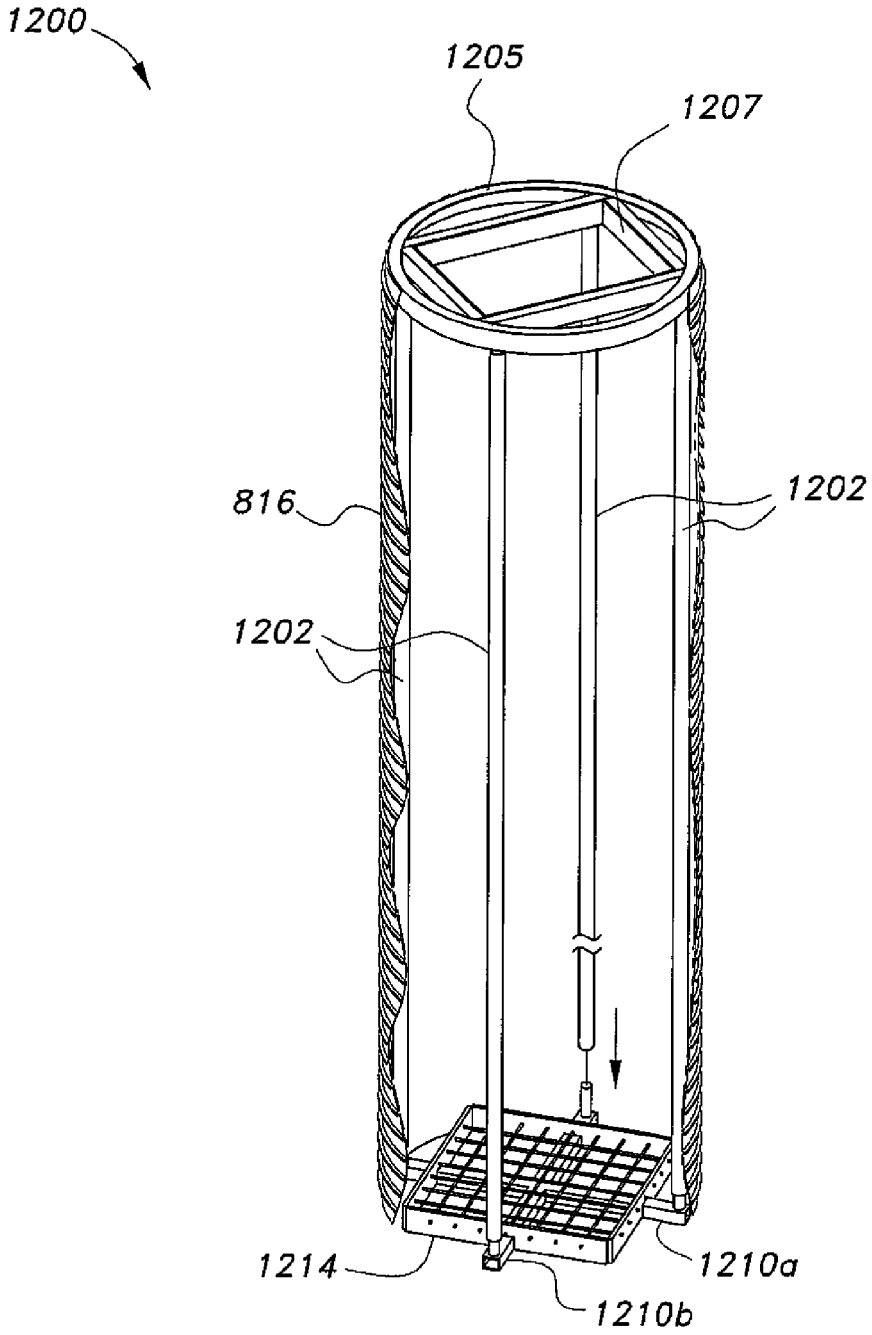
FIG. 12 is a partially exploded perspective view of the steel endoskeleton and the tubular wet well of a portable steel-reinforced HDPE pump station according to the present invention.

The cylindrical HDPE wet well 816 has a high modulus of elasticity and therefore is highly susceptible to temperature changes and will expand and contract accordingly. When used in a horizontal application, the friction with the ground provides resistance to these movements. However, when in a vertical orientation the wet well 816 has no resistance and the material will contract. A vertical basin that is susceptible to movement is not an acceptable material for civil infrastructure, for obvious reasons. Thus, as shown in FIG. 12, a structural reinforcement steel endoskeleton 1200 is used to provide a mechanical restraint to combat vertical contraction and expansion of wet well 816. The steel endoskeleton is much like the steel framing of a building, where it provides all of the necessary structural integrity while being enveloped in protective materials. The endoskeleton 1200 includes a top annular steel ring 1205, which is a circular steel angle that is rolled to match the interior circumference of wet well 816. Four elongate steel columns 1202 are attached via welds to the top annular steel ring 1205 and extend downward towards the bottom portion of the endoskeleton. Steel tube cross beam members 1210*a* and 1210*b* form a perpendicular cross that supports an HDPE stiffener frame 1214 at the bottom portion of the endoskekelton. The steel tube cross beam members 1210*a* and 1210*b* extend beyond the HDPE stiffener frame 1214 and terminate in threaded couplings, which are attached to bottom ends of the elongate steel columns 1202. The steel tube cross beam members 1210*a* and 1210*b* become a part of the concrete base composite section.

The top annular steel ring 1205 attaches to and circumscribes a top rectangular access hatch frame 1207. The interior circumference of the cylindrical wet well 816 attaches to the top annular ring 1205 and extends downward, contacting the elongate steel columns 1202 along their length. This endoskeletal arrangement 1200 reinforces the structural integrity of the attached wet well 816. Moreover the endoskeletal arrangement may be fully encapsulated in HDPE sheet or pipe material to ensure the same attributes and sustainability as the SRPE material. In addition to providing mechanical restraint to the thermal contraction issue, the endoskeleton also contributes to the structural composite base section and enhances the base's ability to resist vertical hydraulic loads.

The endoskeleton also provides a structural mechanism for lifting the pump station into place in the field. By way of the framed bracket inside the top of the pump station's access hatch, a loose steel lifting beam is used to lift the pump station vertically into place. The lifting beam engages the top structural steel frame, and thus the entire endoskeleton, to support the self-weight of the pump station while it is being moved into place. The ability to lift the unit in this manner eliminates the need for any penetrations into the top HDPE plate for lifting points, and thus ensures that all steel within the system remains protected.

Figure 13:
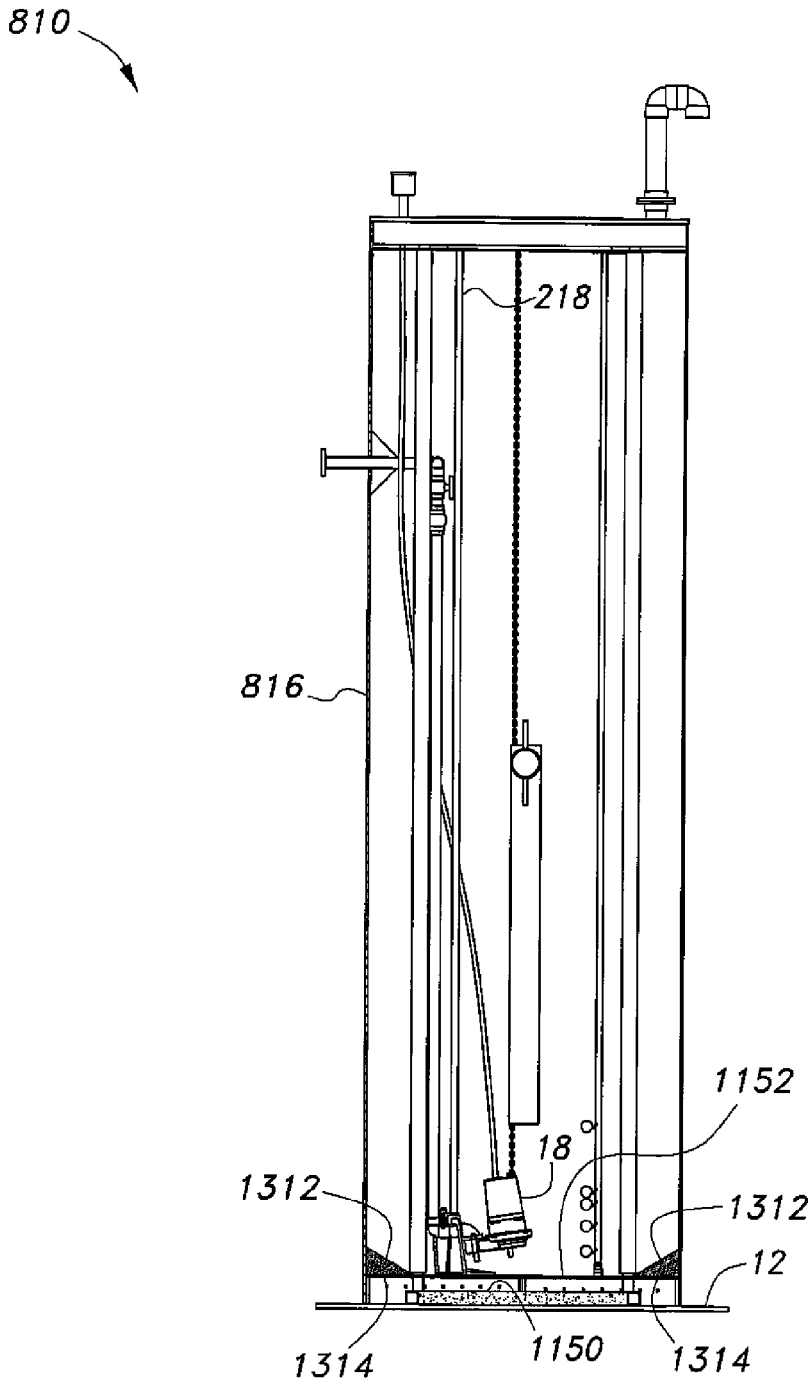
FIG. 13 is a section view of a portable steel-reinforced HDPE pump station with a concrete base according to the present invention.

As shown in FIG. 13, HDPE sheets 1312 may extend at a downward slope from the inner circumferential wall of cylindrical wet well 816 to the HDPE base plate 12 to form a hopper inside the bottom portion of the wet well cylinder 816. The annular space below the angled sheet arrangement is filled with a polyurethane filler 1314. The hopper bottom is a typical feature of vertical pump stations and facilitates the movement of solids to the pump intakes, and also eliminates the potential for solids buildup in dead spots. The sloped sheets 1312 are fuse-welded to the inner circumferential wall of the cylindrical wet well 816 and to the HDPE sheet material 1152 encapsulating the base 1150. The polyurethane filler 1314 is preferably a closed-cell type of polyurethane insulation. The polyurethane filler 1314 creates a solid mass, which ensures that the HDPE sloped sheets 1312 maintain their desired slope. Moreover, it is a sustainable, non-corrosive material, and is an extremely lightweight material. The HDPE sloped sheets 1312 are ideal for maintaining a slick surface to promote the migration of solids to the pump intake due to its inherent nonstick properties.

Figure 14:
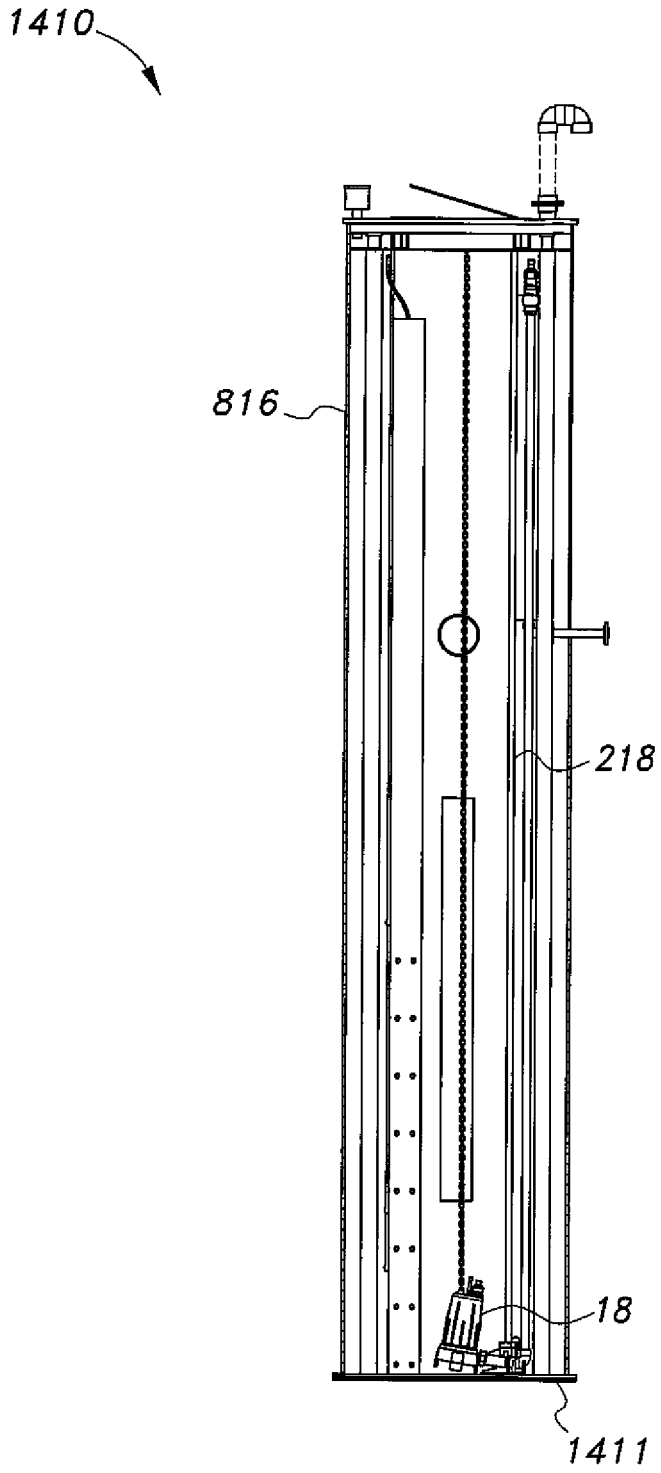
FIG. 14 is a section view of a portable steel-reinforced HDPE pump station with a steel reinforced base according to the present invention.

As shown in FIG. 14, a steel plate composite base 1411 may be used in lieu of the concrete base for the wet well 816. This alternative pump station embodiment 1410 is primarily applicable for smaller diameter pump stations having smaller horsepower pumps. The steel plate composite base 1411 has a steel plate sandwiched between two HDPE sheets. The steel plate is slightly smaller than the HDPE sheets such that the joint around the perimeter of the sandwich section allows the HDPE sheets to be fuse-welded together. The guide rail assembly 218 for the pumps, such as pump 18, is attached to the steel base 1411 by drilling and tapping the steel plate so that anchor bolts can be threaded into place and then welded on the back side of the steel plate. This is done prior to the HDPE sheet being installed. The anchor bolts do not penetrate the bottom anti flotation collar of the wet well. Therefore, the wet well remains entirely watertight and resistant to water intrusion or extrusion. Additionally, the structural reinforcement steel endoskeleton 1200 may be used to provide a mechanical restraint to combat vertical contraction and expansion of the wet well 816 with the steel plate composite base 1411.

It will be understood that the embodiments of FIGS. 8 through 14 will work not only with steel-reinforced polyethylene (SRPE), but also with pump stations or vessels having a wet well made from other types of structurally reinforced thermoplastic materials (SRTP), provided the wet well has an outer shell of high-density polyethylene. Such materials have some form of structural reinforcement, although not necessarily metal or steel, and not necessarily steel ribs spirally wound around the well. Examples of suitable materials include profile Wall HDPE (HDPE formed using a preformed profile), marketed as Weholite by Uponor Infra Corp., and Metal Reinforced HDPE, marketed by Kanaflex Corporation Inc. (a pipe made from a synthetic resin having corrugations formed by spirally wrapping synthetic resin encapsulating steel plates around the pipe, as described in U.S. Patent Publication No. 2009/0117302, published May 7, 2009, and U.S. Pat. No. 8,646,489, issued Feb. 11, 2014).

It is to be understood that the present invention is not limited to the embodiments described above, but encompasses any and all embodiments within the scope of the following claims.

We claim:

1. A portable structurally reinforced thermoplastic pump station, comprising:

a vertically upright cylindrical wet well of structurally reinforced thermoplastic having an outer shell fabricated from thermoplastic material, the wet well having a top portion, and a bottom portion, wherein the wet well further comprises thermoplastic-encapsulated steel reinforcement ribs spirally wound around the wet well;

a thermoplastic sheet wrapping wrapped around the wet well and covering the reinforcement ribs and spaces between the ribs, the thermoplastic sheet wrapping forming a substantially smooth profile around the wet well, wherein the thermoplastic sheet wrapping forms seams fuse-welded together and to the thermoplastic-encapsulated steel ribs to retain the thermoplastic sheet wrapping around the wet well;

at least one pump disposed in the wet well;

an outlet pipe attached to the at least one pump, the outlet pipe extending external to the wet well, the outlet pipe allowing effluent water to exit the wet well;

an inlet pipe extending into the wet well for receiving water, the inlet pipe providing for entry of water inside the wet well; and a base plate encapsulated by a layer of thermoplastic material, the bottom portion of the wet well being attached to and extending therefrom.

2. The portable structurally reinforced thermoplastic pump station according to claim 1, wherein the base plate comprises steel.

3. The portable structurally reinforced thermoplastic pump station according to claim 1, further comprising:

thermoplastic sheets extending at a downward slope from an inner circumferential wall of the wet well to the base plate to define a hopper inside the bottom portion of the wet well; and foam insulation filling an annular space between the sloping thermoplastic sheets and the base plate, the foam insulation retaining a shape of the hopper.

4. The portable structurally reinforced thermoplastic pump station according to claim 1, wherein the base plate comprises concrete.

5. The portable structurally reinforced thermoplastic pump station according to claim 4, wherein the base plate further comprises:

a lattice formed by elongate thermoplastic stiffener cross rib members at the bottom of the wet well, the concrete being poured inside the lattice; and steel rods extending through and anchored to the thermoplastic stiffener cross rib members, the steel rods reinforcing the concrete inside the lattice.

6. The portable structurally reinforced thermoplastic pump station according to claim 1, wherein the wet well further comprises thermoplastic-encapsulated steel reinforcement ribs spirally wound around the wet well, the pump station further comprising foam insulation disposed around the wet well and filling spaces between the steel reinforcement ribs, the foam insulation forming a substantially smooth profile outside the wet well.

7. The portable structurally reinforced thermoplastic pump station according to claim 1, further comprising;

an access hatch disposed at an upper portion of the wet well;

sliding rails disposed in the wet well, the sliding rails extending proximate to the access hatch, the at least one pump being slidably attached to the sliding rails, thereby facilitating installation and access to the at least one pump for removal through the access hatch.

8. The portable structurally reinforced thermoplastic pump station according to claim 7, further comprising means for attaching at least one of the pump guiding sliding rails to the base plate.

9. The portable structurally reinforced thermoplastic pump station according to claim 1, further comprising a water level monitor disposed in the wet well, the water level monitor activating the at least one pump when water level in the wet well exceeds a first predetermined level and deactivating the at least one pump when water level in the wet well falls below a second predetermined level.

10. The portable structurally reinforced thermoplastic pump station according to claim 1, further comprising:

a top annular steel ring rolled to match an interior circumference of the wet well, the top portion of the wet well defining a top interior circumference, the top annular steel ring being attached to the top interior circumference of the wet well;

a steel rectangular access hatch frame circumscribed by the top annular steel ring;

a plurality of elongate steel columns attached to the top annular steel ring and extending downward into the bottom portion of the wet well, the steel columns constraining vertical contraction and expansion of the wet well; and threaded couplings extending from the base plate, the steel columns having bottom ends attached to the couplings.

11. The portable structurally reinforced thermoplastic pump station according to claim 10, further comprising thermoplastic sheet material fully encapsulating the top annular steel ring, steel rectangular access hatch frame, and the elongate steel columns.

12. The portable thermoplastic pump station according to claim 10, wherein the base plate comprises concrete, the pump station further comprising:

a plurality of elongate thermoplastic stiffener cross rib members forming a lattice defining a frame at the bottom of the wet well, the concrete being poured inside the lattice;

a plurality of steel rods extending through and anchored to the thermoplastic stiffener cross rib members, the steel rods reinforcing the concrete inside the lattice; and a plurality of steel crossbeam members forming a perpendicular cross supporting the frame formed by the thermoplastic stiffener cross rib members, the threaded couplings being attached to the steel crossbeam members so that the crossbeam members support said steel columns.

13. A portable structurally reinforced thermoplastic pump station, comprising:

a vertically upright cylindrical wet well of structurally reinforced thermoplastic having an outer shell fabricated from thermoplastic material, the wet well having a top portion, and a bottom portion;

at least one pump disposed in the wet well;

an outlet pipe attached to the at least one pump, the outlet pipe extending external to the wet well, the outlet pipe allowing effluent water to exit the wet well;

an inlet pipe extending into the wet well for receiving water, the inlet pipe providing for entry of water inside the wet well;

a base plate encapsulated by a layer of thermoplastic material, the bottom portion of the wet well being attached to and extending therefrom;

a top annular steel ring rolled to match an interior circumference of the wet well, the top portion of the wet well defining a top interior circumference, the top annular steel ring being attached to the top interior circumference of the wet well;

a steel rectangular access hatch frame circumscribed by the top annular steel ring;

a plurality of elongate steel columns attached to the top annular steel ring and extending downward into the bottom portion of the wet well, the steel columns constraining vertical contraction and expansion of the wet well; and threaded couplings extending from the base plate, the steel columns having bottom ends attached to the couplings.

* * * * *